US007270437B1

(12) United States Patent
Racoosin et al.

(10) Patent No.: US 7,270,437 B1
(45) Date of Patent: Sep. 18, 2007

(54) ILLUMINATION DEVICE FOR A GUEST CHECK PRESENTER

(76) Inventors: Eric Racoosin, 25341 Piedra Blanca, Laguna Niguel, CA (US) 92677; Jeff Timper, 410 Calle Nina, San Clemente, CA (US) 92672

( * ) Notice: Subject to any disclaimer, the term of this patent is extended or adjusted under 35 U.S.C. 154(b) by 25 days.

(21) Appl. No.: 11/230,073

(22) Filed: Sep. 19, 2005

(51) Int. Cl.
*A47B 19/00* (2006.01)

(52) U.S. Cl. ..... 362/98; 362/234; 362/240

(58) Field of Classification Search ..... None
See application file for complete search history.

(56) References Cited

U.S. PATENT DOCUMENTS

| | | | | |
|---|---|---|---|---|
| 4,290,093 | A | 9/1981 | Thompson et al. | |
| 5,016,147 | A * | 5/1991 | Voorhees | 362/99 |
| 5,041,954 | A * | 8/1991 | Forrest, Jr. | 362/234 |
| 5,355,115 | A * | 10/1994 | Goor et al. | 340/321 |
| 5,639,156 | A | 6/1997 | Broxson | |
| 5,699,039 | A * | 12/1997 | Korzen | 340/311.2 |
| 5,813,748 | A | 9/1998 | Maxymych | |
| 6,302,563 | B1 | 10/2001 | Yama | |
| 6,409,357 | B1 | 6/2002 | Thompson et al. | |
| 6,796,673 | B1 | 9/2004 | Dempsey et al. | |
| 6,808,208 | B2 * | 10/2004 | Ward | 281/31 |
| 6,851,822 | B2 * | 2/2005 | Herrera | 362/99 |
| 7,163,307 | B1 * | 1/2007 | Clark et al. | 362/99 |
| 2001/0030863 | A1 * | 10/2001 | Contant et al. | 362/154 |
| 2004/0099546 | A1 * | 5/2004 | Schlosser | 206/232 |
| 2007/0030163 | A1 * | 2/2007 | Waterhouse | 340/815.4 |

* cited by examiner

*Primary Examiner*—Renee Luebke
*Assistant Examiner*—Kristen A Manskar
(74) *Attorney, Agent, or Firm*—Eric Karich

(57) ABSTRACT

An illumination device for illuminating a guest check presenter has a housing having a top surface and a bottom surface connected by a sidewall; an adhesive element disposed on the bottom surface and adapted to mount the device on the guest check presenter; the sidewall separating the top and bottom surfaces by a distance (D) that is small enough to enable the guest check presenter to be closed when the illumination device is mounted on the guest check presenter; an illumination LED mounted adjacent the sidewall for illuminating the guest check presenter; a battery mounted within the housing; and a switch operably connecting the battery with the illumination LED.

2 Claims, 1 Drawing Sheet

ILLUMINATION DEVICE FOR A GUEST CHECK PRESENTER

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to illumination devices, and more particularly to an illumination device adapted to illuminate a guest check presenter.

2. Description of Related Art

The following art defines the present state of this field:

Schlosser, et al., U.S. 2004/0099546, teaches a guest check presenter that includes an LED mounted on the front face of a light-emitting device for illuminating the check through a magnifying sheet. The guest check presenter also includes a plurality of signaling lights on an outer edge of the light-emitting device that are adapted to alert the waiter to pick up the check when the patron is ready to pay.

A disadvantage of such a device is that once the guest check presenter becomes worn, the entire device (including the lights) must be thrown away and replaced. Furthermore, the red LED signal light may be the best suited for signaling the server. Other prior art references include similar drawbacks and weaknesses.

Ward, U.S. Pat. No. 6,808,208, teaches guest check presenter that includes a lighting element and switch mounted on the back panel of the guest check presenter a for making it easier for the customer to be able to read one's tab/check upon the receipt thereof.

Thompson, et al., U.S. Pat. No. 6,409,357, teaches a guest check presenter or similar folder that is automatically illuminated, when the covers are opened, by a source of illumination affixed to at least one of the covers adjacent an edge surface thereof. The other of the covers includes a notch in opposite position to overlie the source when the covers are folded closed, thereby retaining the page substantially flat—with electronic switch means serving to energize the illumination source only when the front and back covers are separated.

Dempsey, et al., U.S. Pat. No. 6,796,673, teaches a guest check presenter with an illuminated signaling beacon for signaling a server that the billfold and payment are ready to be collected. The signaling beacon is mounted on the front of the billfold and includes a pressure-actuating electrical or mechanical switch that turns on and off a light source such as an LED. The light source is enclosed in a housing comprising a bracket mounted on the front of the billfold and a back plate mounted on the inside of the billfold, where the bracket and back plate cooperate to sandwich a front panel of the billfold there between.

A similar signaling mechanism is also shown in Goor, et al., U.S. Pat. No. 5,355,115.

Maxymych, et al., U.S. Pat. No. 5,813,748, teaches a transaction tray comprising a tray portion and a hinged lid portion. The tray portion has a transaction compartment and a storage compartment, and lighting means associated with the transaction compartment. The lid portion has a flat outer surface and a parallel inner surface. A first transparent window is provided in the outer surface of the lid and a second transparent window in the inner surface. A first translucent advertising substrate is displayed in the first window and a second translucent advertising substrate is displayed in the second window. A lighting means is provided between the first and second translucent substrates whereby the transaction tray will be lit by the lighting means and the translucent advertising substrates will be displayed and backlit from both sides of the hinged lid.

Yama, U.S. Pat. No. 6,302,563, teaches a lighted check holder device for easily reading and completing the check or invoice transactions. The lighted check holder device includes a first cover member being hingedly attached to one of the side walls of the check support member and being closeable over the recessed portion in the top wall of the check support member; and further includes a light-emitting assembly for providing light to a check or invoice removably received in the recessed portion.

Broxson, U.S. Pat. No. 5,639,156, teaches a portable illumination device for reading material in dark or underlit environments. This illumination device is operable upon the opening of its book-like folded covers and upon the tilting of the device to a pre-set angle or greater to close a circuit containing a mercury tilt switch, battery and sources of illumination. Once the device is properly positioned, the plurality of individual illumination sources are activated to illuminate the reading material placed therein. A reading bar incorporating a magnifying glass can be slid along the reading material so as to magnify or highlight such material for easier reading thereof. The tilt switch and battery power sources are preferably located along the spine of the device.

Thompson, et al., U.S. Pat. No. 4,290,093, teaches a case for holding and illuminating an open magazine, or the like.

The above-described references are hereby incorporated by reference in full.

The prior art teaches various illumination devices that are adapted to be built into guest check presenters. However, the prior art does not teach an illumination device that includes an adhesive element that enables the illumination device to be attached to a standard guest check presenter. The prior art also does not teach an illumination device that may be removed from a guest check presenter when the guest check presented becomes worn out, and reattached to a new guest check presenter. Finally, the prior art does not teach an illumination device that is adapted to hold and illuminate a credit card such that it extends from the guest check presenter, thereby signaling a server to come and pick up the guest check presenter. The present invention fulfills these needs and provides further related advantages as described in the following summary.

SUMMARY OF THE INVENTION

The present invention teaches certain benefits in construction and use which give rise to the objectives described below.

The present invention provides an illumination device for illuminating a guest check presenter. The illumination device includes a housing having a top surface and a bottom surface connected by a sidewall; an adhesive element disposed on the bottom surface and adapted to mount the device on the guest check presenter; the sidewall separating the top and bottom surfaces by a distance (D) that is small enough to enable the guest check presenter to be closed when the illumination device is mounted on the guest check presenter; an illumination LED mounted adjacent the sidewall for illuminating the guest check presenter; a battery mounted within the housing; and a switch operably connecting the battery with the illumination LED.

A primary objective of the present invention is to provide an illumination device having advantages not taught by the prior art.

Another objective is to provide an illumination device that may be attached with an adhesive element to a prior art guest check presenter, without requiring the purchase of a different guest check presenter.

Another objective is to provide an illumination device that may be removed from old guest check presenters and reattached with the adhesive element (or a new adhesive element) to a new guest check presenter.

A further objective is to provide an illumination device that is adapted to hold and illuminate a credit card such that the credit card extends from the guest check presenter, thereby signaling a server to pick up the guest check presenter.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
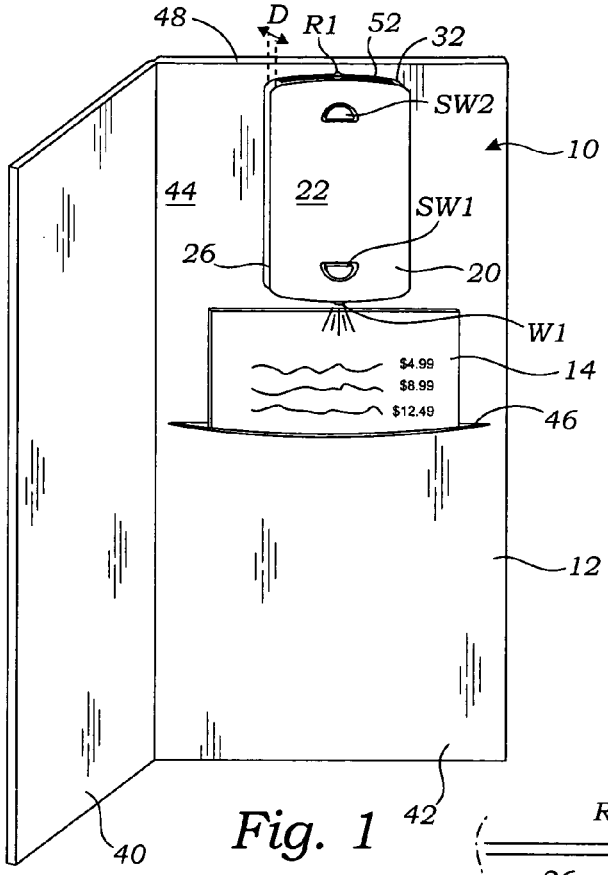
FIG. 1 is an exploded perspective view of an illumination device mounted on a check presenter to illuminate a guest check, according to a preferred embodiment of the present invention.

The above-described drawing figures illustrate the invention, an illumination device (10) for illuminating a guest check presenter (12). Briefly stated, the illumination device (10) includes an illumination LED (W1) for illuminating a guest check (14) in a darkened restaurant, and the illumination device (10) preferably further includes a slot (52) for receiving a credit card (54) and a signaling LED (R1) for illuminating the credit card (54) and alerting a server that payment is ready to be picked up.

As shown in FIG. 1, the illumination device (10) includes a housing (20) having a top surface (22) and a bottom surface (24) (shown in FIG. 2) connected by a sidewall (26). Since the illumination device (10) is adapted to fit within the guest check presenter (12) when the guest check presenter (12) is closed, the top and bottom surfaces (22 and 24) are preferably generally planar in construction, although some curvature is expected for a pleasing appearance, and the sidewall (26) is preferably as thin as possible. The sidewall (26) should separate the top and bottom surfaces (22 and 24) by a distance (D) that is small enough to enable the guest check presenter (12) to be closed when the illumination device (10) is mounted within the guest check presenter. The housing (20) is preferably formed of plastic or similar material, although it could potentially be formed of other sturdy material suitable for the application.

Figure 2:
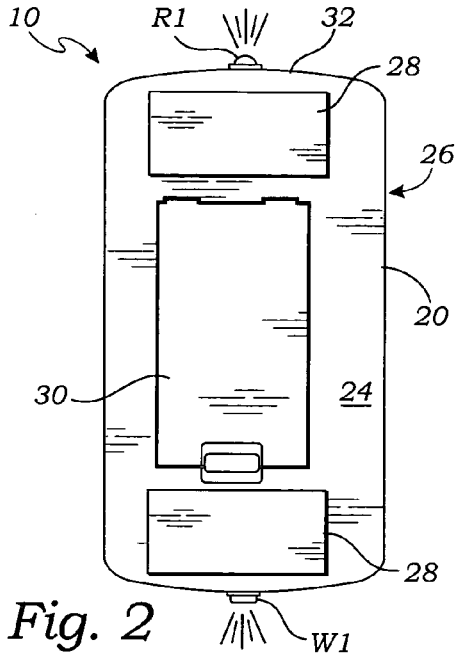
FIG. 2 is a rear elevational view of the illumination device.

As shown in FIG. 2, an adhesive element (28) is disposed on the bottom surface (24) and adapted to mount the device on the guest check presenter. In the preferred embodiment, the adhesive element (28) is a double-sided adhesive tape that may include a peel-removable liner (not shown) when the illumination device (10) is initially sold and shipped. The illumination device (10) is adapted to be used in conjunction with a standard guest check presenter (12), and the illumination device (10) is merely applied to the guest check presenter (12) with the adhesive element (28). Once the guest check presenter (12) becomes worn, the illumination device (10) can be removed from the guest check presenter (12). In some embodiments, the adhesive element (28) may include an adhesive that is weak enough to allow the illumination device (10) to be peeled from the guest check presenter (12) and reapplied to another guest check presenter (12).

In another embodiment, the adhesive element (28) could simply be removed, and replaced with another layer of adhesive tape or other form of adhesive. Since the guest check presenter (12) is going to be discarded in any case, damage to the guest check presenter (12) is not a problem, as long as the illumination device (10) can be reused.

Figure 4:
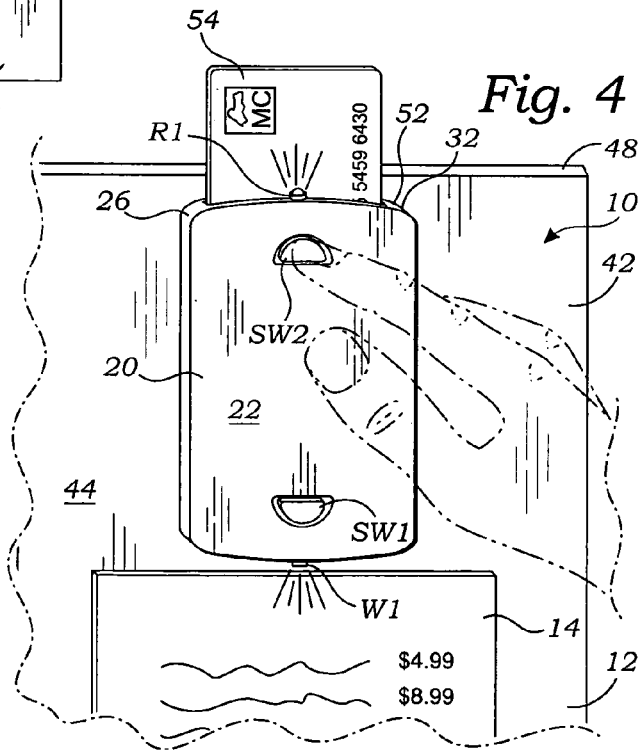
FIG. 4 is a perspective view of the illumination device, illustrating how a credit card can be inserted into and illuminated by the illumination device.

As shown in FIGS. 1 and 4, the guest check presenter (12) typically includes a front panel (40) and a back panel (42), the back panel (42) having a pocket (46) for receiving the guest check (14). In use, the illumination device (10) is mounted, using the adhesive element (28), to an inner surface (44) of the back panel (42), oriented as described below.

As shown in FIG. 2, the bottom surface (24) may also include a removable cover (30) that may be removed for inserting and/or replacing a battery (50), described below.

Figure 3:
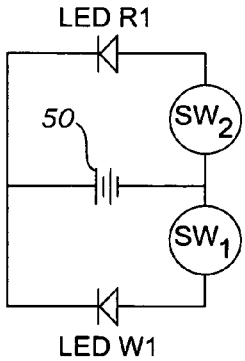
FIG. 3 is an electrical schematic of the illumination device.

As shown in FIGS. 1-4, the illumination device (10) includes an illumination LED (W1) mounted adjacent the sidewall (26) for illuminating the guest check presenter (12). As shown in FIG. 3, the illumination device (10) further includes a battery (50) mounted within the housing (20), and a switch (SW1) operably connecting the battery (50) with the illumination LED (W1). In use, the switch (SW1), such as a push-button switch (SW1), is depressed, thereby illuminating the illumination LED (W1), which illuminates the guest check (14).

For purposes of this application, the term "LED" is expressly defined to include not only light emitting diodes, but also similar or equivalent illumination elements, such as filament bulbs, electro-luminescent (EL) materials, and other similar or equivalent elements. Furthermore, while the term refers to a singular element, this is hereby defined to also include multiple lighting elements. In the preferred embodiment, the illumination LED (W1) is a white light emitting diode; however, the illumination LED (W1) could also include multiple lighting elements, and it could also include multiple colored LEDs, which could be arranged to combine to form white light, or another color that is suitable for illuminating the guest check (14).

In the preferred embodiment, as show in FIG. 4, the illumination device (10) further includes a slot (52) through the sidewall (26). The slot (52) is adapted to receive and frictionally hold a credit card (54). The illumination device (10) preferably further includes a signaling LED (R1) positioned above the slot (52) for illuminating the credit card (54) when the credit card (54) is positioned within the slot (52). In the preferred embodiment, the signaling LED (R1) is a red light emitting diode operably connected to the battery (50) with a second switch (SW2). As discussed above, the signaling LED (R1) could be another form of lighting element or elements, could be another color, or any other obvious or equivalent variation. In the preferred embodiment, the signaling LED (R1) and the slot (52) are positioned on the sidewall (26) opposite the illumination LED (W1).

In use, as shown in FIGS. 1 and 4, the illumination device (10) is used to practice a unique method for illuminating a guest check presenter (12). The method comprising the steps of first providing the illumination device (10) described above, and a guest check presenter (12).

The guest check presenter (12) may be any such folder already known and used in the prior art. The guest check presenter (12) includes right and left covers, and the right cover includes an inner surface (44) with a pocket (46) for receiving the guest check (14).

The illumination device (10) is mounted with the adhesive element (28) on the inner surface (44) of the guest check presenter (12) such that the illumination LED (W1) illuminates the guest check presenter (12). As shown in FIG. 1, the illumination LED (W1) is preferably positioned to illuminate the pocket (46) of the guest check presenter (12), so that the guest check (14) will be illuminated when positioned therein.

In the preferred embodiment, as shown in FIG. 4, an upper edge (32) of the illumination device (10) is preferably positioned at a top edge (48) of the guest check presenter (12), so that the slot (52) is adjacent to the top edge (48) of the guest check presenter (12). In this manner, when the credit card (54) is positioned in the slot (52), it extends from the guest check presenter (12) and is illuminated by the signaling LED (R1). In this configuration, a guest may read the guest check (14) with the aid of the illumination LED (W1), then insert the credit card (54) for payment. By illuminating the signaling LED (R1), the credit card (54) is illuminated with a red light (or white, or other color, if desired), thereby signaling the server to pick up the guest check presenter (12) for payment.

Certain terminology is used in the preceding description for convenience only, and is not limiting. Words such as "right," "left," "up," "down," "upper," "lower," and the like, designate directions in the drawings to which reference is made.

Words such as "inner" and "outer" refer to directions toward and away from, respectively, from the geometric center of the guest check presenter (12) when closed. The terminology includes the words described above, similar or equivalent words, and derivatives thereof. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An illumination device for illuminating a guest check presenter and for receiving a credit card, the illumination device comprising:

a housing having a top surface and a bottom surface connected by a sidewall;

an adhesive element disposed on the bottom surface and adapted to mount the device on the guest check presenter;

the sidewall separating the top and bottom surfaces by a distance that is small enough to enable the guest check presenter to be closed when the illumination device is mounted on the guest check presenter;

an illumination LED mounted adjacent the sidewall for illuminating the guest check presenter;

a battery mounted within the housing;

a switch operably connecting the battery with the illumination LED;

a slot through the sidewall adapted to receive the credit card between the top surface and the bottom surface; and a signaling LED positioned opposite the illumination LED and above the slot for illuminating the credit card when the credit card is positioned within the slot.

2. A method for illuminating a guest check presenter, the method comprising the steps of:

providing an illumination device comprising:

a housing having a top surface and a bottom surface connected by a sidewall;

an adhesive element disposed on the bottom surface;

an illumination LED mounted on the housing;

a battery mounted within the housing;

a switch operably connecting the battery with the illumination LED;

a slot through the sidewall adapted to receive the credit card between the top surface and the bottom surface; and a signaling LED positioned opposite the illumination LED and above the slot;

providing a guest check presenter having an inner surface and a top edge;

mounting the device with the adhesive element on the inner surface of the guest check presenter adjacent the top edge;

actuating the switch such that the illumination LED illuminates the guest check presenter;

inserting a credit card into the slot; and illuminating the credit card with the signaling LED when the credit card is positioned within the slot.

* * * * *